US006679651B2

(12) United States Patent
Robinson

(10) Patent No.: US 6,679,651 B2
(45) Date of Patent: Jan. 20, 2004

(54) METHOD OF CONVERTING EXISTING NEGATIVE PRESSURE TANK ACCESS WAYS

(75) Inventor: Mark D. Robinson, Black River, NY (US)

(73) Assignee: The Stebbins Engineering and Manufacturing Company, Watertown, NY (US)

( * ) Notice: Subject to any disclaimer, the term of this patent is extended or adjusted under 35 U.S.C. 154(b) by 0 days.

(21) Appl. No.: 10/118,329

(22) Filed: Apr. 9, 2002

(65) Prior Publication Data

US 2002/0176742 A1 Nov. 28, 2002

Related U.S. Application Data

(60) Provisional application No. 60/282,184, filed on Apr. 9, 2001.

(51) Int. Cl.[7] ..... E02D 29/14
(52) U.S. Cl. ..... 404/25; 52/20
(58) Field of Search ..... 52/19, 20; 404/25, 404/26

(56) References Cited

U.S. PATENT DOCUMENTS

| | | | | |
|---|---|---|---|---|
| 2,744,654 A | * | 5/1956 | Swerdlow | 220/327 |
| 3,077,360 A | * | 2/1963 | Israel | 292/256.67 |
| 3,591,124 A | | 7/1971 | Haslett | |
| 3,721,363 A | * | 3/1973 | Bressler et al. | 220/315 |
| 3,744,670 A | * | 7/1973 | De Frees | 220/314 |
| 4,021,014 A | | 5/1977 | Craig | |
| 4,767,095 A | | 8/1988 | Fitzgerald et al. | |
| 4,887,789 A | | 12/1989 | Harris et al. | |
| 5,366,317 A | * | 11/1994 | Solimar | 404/25 |
| 5,394,650 A | * | 3/1995 | Dean | 49/386 |
| 5,535,565 A | | 7/1996 | Majnaric et al. | |
| 5,874,016 A | | 2/1999 | Bacon, Jr. et al. | |
| 6,109,823 A | | 8/2000 | Halferty et al. | |
| 6,371,698 B1 | | 4/2002 | Beck, III et al. | |

* cited by examiner

*Primary Examiner*—Robert E. Pezzuto
*Assistant Examiner*—Alexandra K. Pechhold
(74) *Attorney, Agent, or Firm*—Shlesinger, Arkwright & Garvey LLP

(57) ABSTRACT

Method of replacing a blind flange manhole cover of the type including a bolted on blind flange mounted on a bolting flange of a negative pressure storage tank manway with a manhole cover having a hinged door assembly includes the step of removing the blind flange manhole cover from the bolting flange of a tank-installed manway. The manhole cover may be attached to the bolting flange of the existing manway. A seal may be provided for creating a leakproof joint between the cover and a cover receiving surface when the hingedly attached manhole cover is in a closed position. A manway having a hingedly attached manhole cover may be provided with a hinge frame. A locking assembly may be provided adjacent the cover that includes a locking and sealing element for engaging the cover with a seal for locking and sealing the manway.

17 Claims, 4 Drawing Sheets

FIG. 1
PRIOR ART
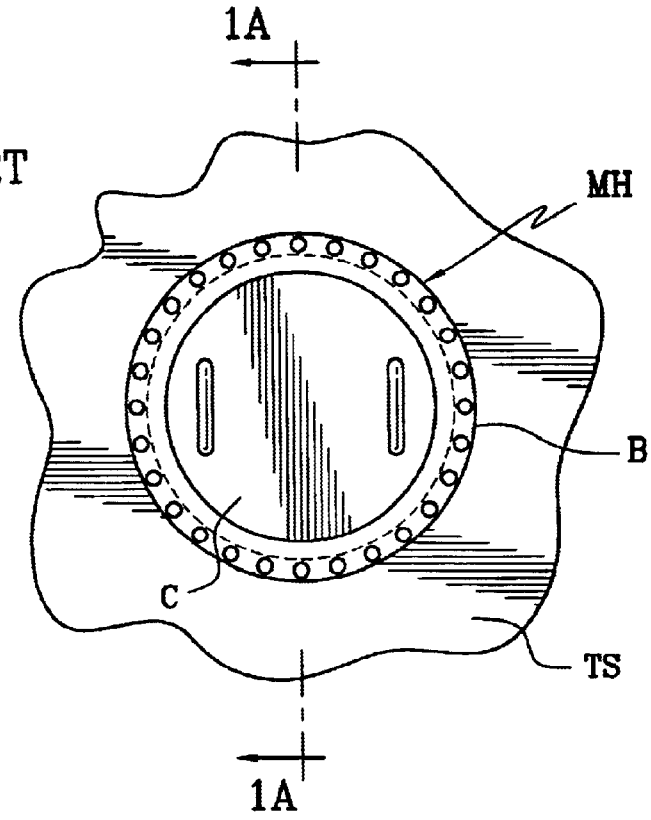
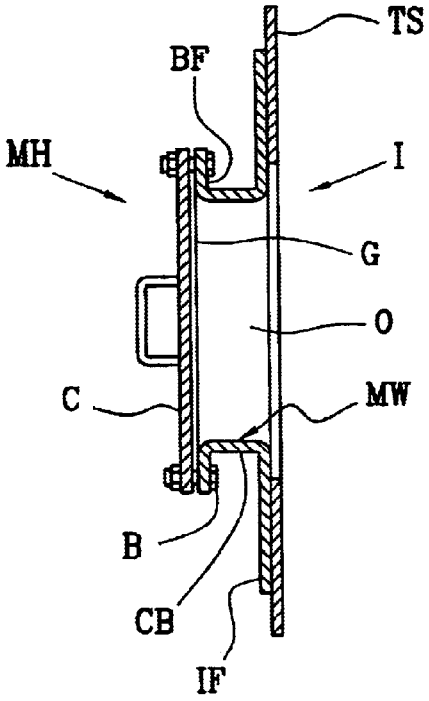
FIG. 1A
PRIOR ART

METHOD OF CONVERTING EXISTING NEGATIVE PRESSURE TANK ACCESS WAYS

CROSS REFERENCE TO RELATED APPLICATIONS

This application claims the priority of application No. 60/282,184, filed Apr. 9, 2001, which is incorporated herein by reference.

FIELD OF THE INVENTION

This invention relates to an access manhole that is mounted in a negative pressure storage or process tank or the like and, in particular, to a method of replacing a manhole cover including a bolted-on blind flange with a manhole cover including a hinged door assembly.

BACKGROUND OF THE INVENTION

Many negative pressure storage or process tanks and, in particular, older tanks, are equipped with manholes that include covers that open outwardly with regard to the tank. Typically, the cover is bolted to a flange that encircles the outside of a cylindrical manway. The term manway, as herein used, refers to a tubular member that is welded or otherwise joined to the tank to provide access into the tank.

Replacing a manhole with a bolted-on blind flange within a negative pressure storage tank with a more preferred hinged door assembly has heretofore presented certain structural difficulties where the existing manway is removed from the tank and replaced with an entirely new manhole unit.

Complete removal of the existing manhole can produce structural damage to the tank shell in and about the manway opening that oftentimes requires extensive repair to the tank. Furthermore, retrofitting a new manway to the repaired opening is sometimes difficult and can result in damage to existing tank coatings, linings or insulation.

DESCRIPTION OF THE RELATED ART

Turning initially to FIGS. 1 and 1A, there is shown a typical negative pressure manhole MH which is constructed in accordance with the American Petroleum Institute (A.P.I.) Standard 650 welded steel tanks for oil storage.

The manhole MH includes a manway MH that surrounds an opening O formed in the tank shell TS that communicates with the interior I of the tank. The manway MW contains a cylindrical body section CB having an inner flange IF which is welded to the tank shell TS and an outer bolting flange BF. A cover C is secured to the outer flange by a number of bolts B. A gasket G is generally mounted between the outer flange and the cover C to prevent leakage from the tank to the surrounding environment. Although the manway MW is shown oriented vertically, the actual orientation could vary anywhere from vertical upward opening to horizontal to vertical downward opening.

The manhole has certain disadvantages with regard to opening and closing, and it is oftentimes desirable to replace the manholes having bolted-on blind flanges with ones that include a hinged door assembly. The conversion, however, can cause damage to a steel tank or weaken the tank, particularly in the case where the existing manway is cut away from the tank shell and replaced with a completely new unit. In the case of a tank constructed of refractory bricks or the like, damage can also be extensive and the amount of repairs required to place the tank back in service is rather costly.

As will be described in detail below, the present invention relates to a method of converting an existing manhole having a bolted-on blind flange with one that has a hinged door assembly so that it causes little or no damage to either a steel or refractory tank.

The inventive method of converting a tank is also more cost effective that those previously employed in the industry.

SUMMARY OF THE INVENTION

It is therefore an object of the present invention to provide an improved method of converting existing manholes in negative pressure storage tanks or the like so that the cover of the manhole is opened and closed using a hinged door assembly rather than unbolting and bolting a blind flange.

A further object of the present invention is to replace an existing manhole in a negative pressure storage tank with a minimum of damage or no damage being done to the tank structure.

A still further object of the present invention is to reduce the amount of time required to replace a manhole with a bolted-on blind flange in a negative pressure storage tank with one having a hinged door assembly.

These and other objects of the present invention are attained by converting an existing manhole in a tank which has a blind flange cover mounted upon a bolting flange with a cover unit including a hinged door assembly. The conversion is accomplished by removing the blind flange from the bolting flange of the existing manway. A hinged door assembly is joined to a mounting flange and the mounting flange is attached to the existing bolting flange. An outwardly opening cover unit is rotatably mounted upon the hinge assembly so that it closes against the rim of the manway.

BRIEF DESCRIPTION OF THE DRAWINGS

For a better understanding of these and other objects of the present invention, reference will be made to the following detailed description of the invention which is to be read in conjunction with the accompanying drawings, wherein:

FIG. 1 is a partial top plan view of a PRIOR ART manhole cover having a bolted-on blind flange that is mounted upon a negative pressure storage tank;

FIG. 1A is a sectional view taken along line 1A—1A of the PRIOR ART manhole cover of FIG. 1;

Relative terms such as up, down, left, and right are for convenience only and are not intended to be limiting.

DESCRIPTION OF THE INVENTION

FIGS. 1 and 1*a* illustrate a PRIOR ART manhole cover having a bolted-on blind flange that is mounted upon a negative pressure storage tank, as described in detail above.

Figure 2:
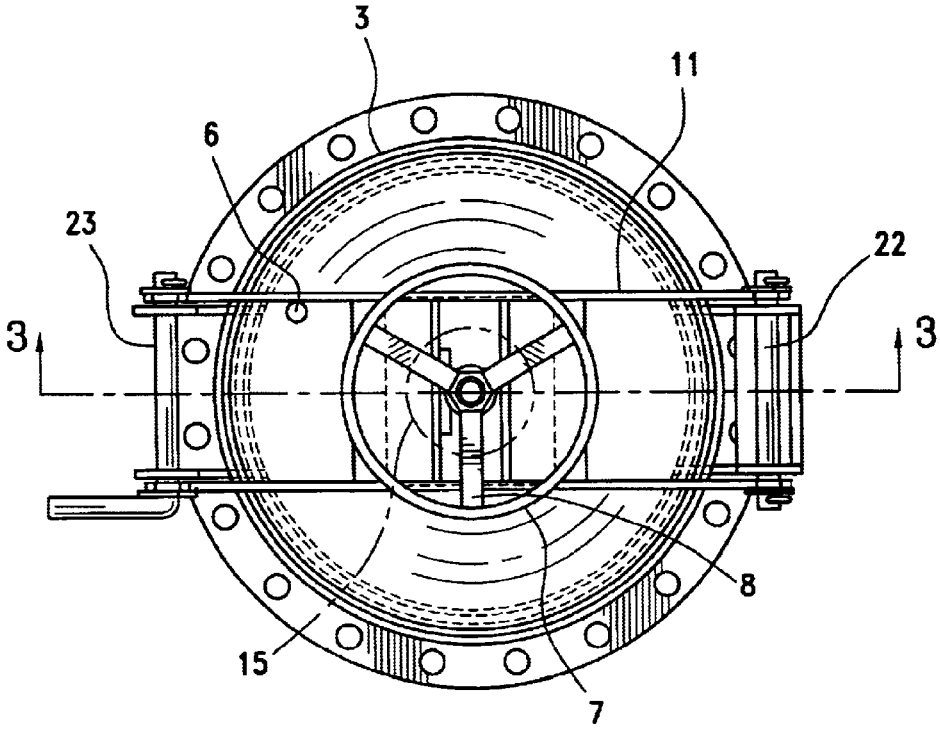
FIG. 2 is a partial top view of a preferred embodiment of the present invention.
Figure 3:
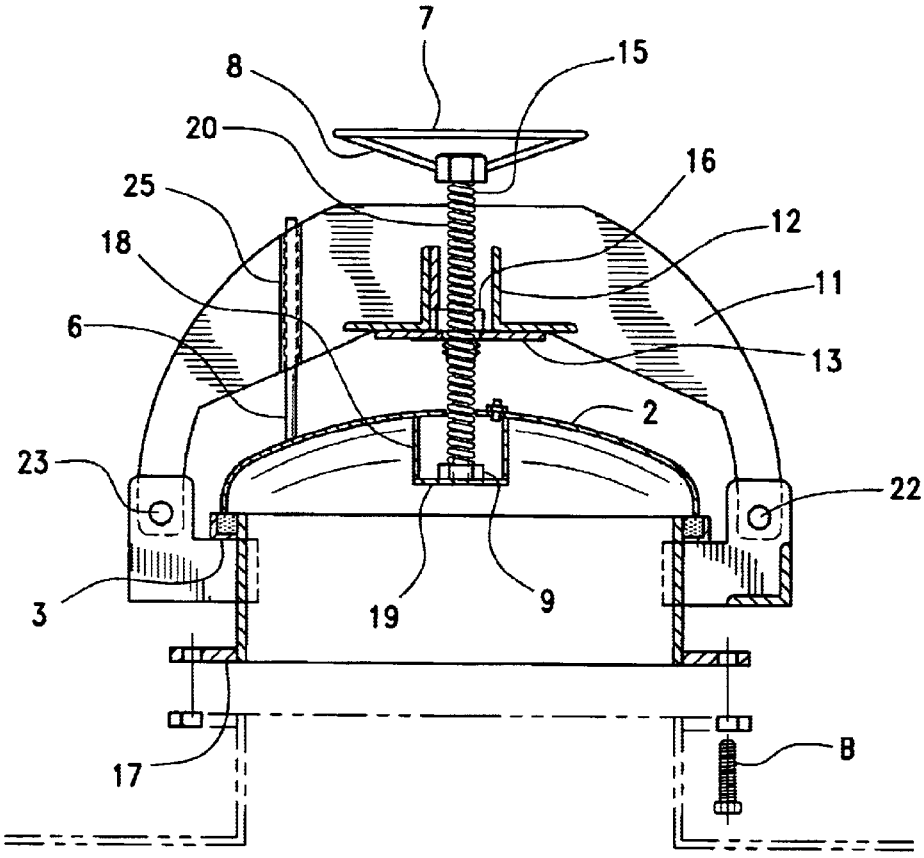
FIG. 3 is a sectional view taken along lines 3—3 in FIG. 2.
Figures 4, 5:
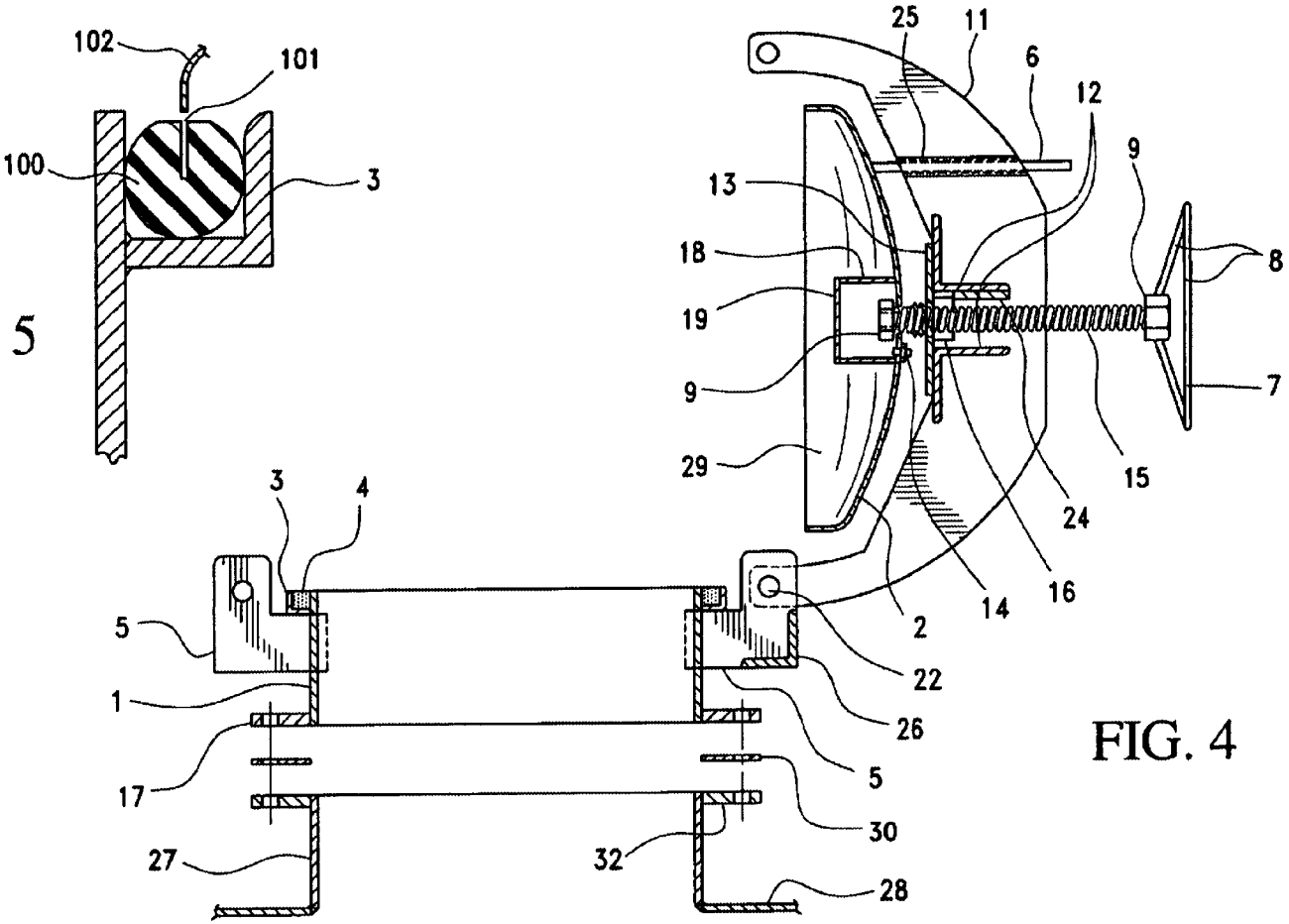
FIG. 4 is a components detail of the preferred embodiment of the invention according to FIG. 2.
FIG. 5 is a sectional view of further preferred embodiment of a sealing arrangement according to the invention.

Turning to FIGS. 2–4 there is illustrated a manhole 27 that is installed in a negative pressure tank 28 which is similar in construction to that described in the American Petroleum Industry Standard 650. See FIG. 4.

Manhole 27 has already been retrofitted in accordance with the invention to accept a hinged door cover assembly 29, as described in detail below. The cover assembly 29 may be conventional and includes a dome shaped cover 2 that is connected to a threaded locking post 15 of a locking and/or sealing assembly 20 so that the cover 2 can be tightly sealed in a manway rim 3 and a gasket 4 of manhole or manway 1.

A pair of spaced apart hinge frames including respective first, second, and third frame elements 11, 12, 13 are connected to the cover by locking and/or sealing assembly 20 including a nut 9, a portion 16, and a threaded rod 15.

The entire cover assembly is arranged to swing outwardly about a hinge pin 22 on support 5.

A latch pin 23 is slidably contained at the opposite end of the hinge frame which allows the cover 2 to be secured in a closed position.

A locking post base 19 is also operatively associated with the cover 2, and locking post base 19 is adapted to push the cover 2 toward the manhole 27 during closure. The third hinge frame element 13 mates with the threaded locking post 15.

A hand wheel 7 is pinned via spokes 8 to the distal end of the threaded locking post assembly to facilitate turning of the threaded rod 15. The cover 2 can be drawn down by turning the hand wheel 7 forcing the threaded locking post 15 into the locking post base 19. Locking post base 19 may be secured to cover 2 by an element 18. A lubricant fill device, such as a grease fitting 14, may be provided for lubricating the threads of threaded rod 15 and the associated contacting surfaces.

To convert the existing manway MW, the bolted-on blind flange cover C is removed from the bolting flange BF (FIG. 1A) of the manway MW.

A sealing gasket 30 (FIG. 4) is then placed on the bolting flange 32, and the new hinged door assembly manway 1 is placed on the bolting flange 32. A flange 17 may be aligned with flange 32.

The manway 1 can be either bolted to the bolting flange 32 using the existing bolts B or it can be welded to the bolting flange 32.

To close the manhole as in FIG. 3, the cover 2 is rotated around the hinge pin 22 and the latch pin 23 is secured. The handwheel 7 is turned, causing the threaded locking post 15 to turn relative to and against the third hinge frame element 13, thereby resulting in the nut 9 at the end of the threaded locking post 15 to contact the locking post base 19. Continued turning of the handwheel 7 forces the cover 2 into the manway rim 3 and gasket 4, sealing the manhole 1.

Although the gasket 4 is shown mounted in a peripheral housing 3 (e.g., manway rim or gasket retaining angle 3 of FIG. 3), other suitable sealing arrangements may be similarly employed without departing from the teachings of the present invention.

A further support 26 may be provided on support 5.

Hinge pin 22 may secure cover 2 to manhole 1 at a portion of frame(s) 11.

After cover 2 has been closed as described above, a latch pin 23 may be used to detachably secure hinge frame 11 to support 5.

An external cover alignment pin 6 may be provided between cover 2 and hinge frame 11, for example. Alignment pin 6 may likewise provide rotational stability. A guide 25, such as the illustrated tube, may be used to guide pin 6, so as to ensure proper alignment of frames 11, and cover 2, for example, so that rim 102 engages rim 3 and gasket 4 in the desired manner. Pin 6 may be secured to cover 2 and tube 25 may be secured to hinge frame(s) 11, for example.

A further sealing arrangement is illustrated in FIG. 5.

In this further sealing arrangement, a seal 100 is an annular shaped member which is oval in cross section and which contains a groove 101 that passes downwardly through the top of the seal 100. The seal 100 is fabricated from a resilient rubber-like material. The diameter of the groove 101 may be coextensive with that of a cover rim 102 of cover 2 and the width of the groove 101 may be slightly less than the thickness of the cover 2 (e.g., rim 102). A tight interference fit is thus provided between the groove 101 and rim 3 so that the seal 100 can be press fitted onto the cover 2. The seal thickness is selected so that a secure positive seal is formed at closure.

Other suitable sealing arrangements may also be employed to establish a positive leak-proof joint between the cover and the cover receiving surface.

Further detail is shown in FIG. 2 which is a bottom plan view of the closed manhole of FIG. 3 in accordance with the invention.

As described above, the mounting flange may be bolted to the bolting flange. In addition, the mounting flange may be bolted and/or welded to the bolting flange.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

What is claimed is:

1. A method of replacing a blind flange manhole cover including a bolted-on blind flange that is mounted upon a bolting flange of a negative pressure storage tank manway with an outwardly opening manhole cover having a hinged door assembly, comprising the steps of:

a) removing the blind flange manhole cover from the bolting flange of a tank-installed manway containing a first opening for providing access to the interior of a tank; and b) attaching an outwardly opening manhole cover including a hinged door assembly to the bolting flange of an existing manway.

2. A method as in claim 1, wherein:

a) a seal is provided for creating a leak proof joint between the cover and a cover receiving surface when the cover is in a closed position.

3. A method as in claim 1, wherein:

a) a gasket is mounted between the bolting flange and a mounting flange.

4. A method as in claim 1, wherein:

a) the mounting flange is bolted to the bolting flange.

5. A method as in claim 1, wherein:

a) the mounting flange is welded to the bolting flange.

6. A method as in claim 1, wherein:

a) a seal is provided on the manway; and b) a groove is provided in the seal, the groove being configured for receiving a rim of the cover.

7. A method of converting a blind flange manhole cover on a manway of a storage tank to an outwardly opening hinged door manhole cover, the blind flange manhole cover being bolted to a flange surrounding the manway, comprising the steps of:

a) removing the blind flange manhole cover from the manway of the storage tank;

b) the step of removing the blind flange manhole cover includes unbolting the blind flange manhole cover from the flange;

c) hingedly attaching the outwardly opening hinged door manhole cover to the manway of the storage tank;

d) the step of attaching the outwardly opening hinged door manhole cover includes bolting a portion of the outwardly opening hinged door manhole cover to the flange.

8. A method as in claim 7, wherein:

a) the hinged door manhole cover is welded to the manway.

9. A method as in claim 7, wherein:

a) a seal is provided on the manway; and b) a groove is provided in the seal, the groove being configured for receiving a rim of the cover.

10. A method as in claim 7, wherein:

a) a pin is provided between the outwardly opening hinged door manhole cover and the manway, the pin being disposable for securing the cover to the manway.

11. A method as in claim 10, wherein:

a) a seal is provided on the manway;

b) a locking assembly is provided adjacent the cover; and c) the locking assembly includes a locking and sealing element for engaging the cover with the seal for locking and sealing the manway.

12. A method as in claim 11, wherein:

a) the hinged door manhole cover includes a hinge frame assembly; and b) the locking assembly includes a threaded locking post, the threaded locking post being movable relative to the hinge frame assembly and the cover for locking and sealing the cover with the seal.

13. A method as in claim 12, wherein:

a) the locking assembly includes a locking post base disposed adjacent the threaded locking post, and the locking post base is fixed relative to the cover.

14. A method of converting a blind flange manhole cover on a manway of a storage tank to an outwardly opening hinged door manhole cover, the manhole cover being bolted to the manway, comprising the steps of:

a) removing the blind flange manhole cover from the manway of the storage tank;

b) hingedly attaching the outwardly opening hinged door manhole cover to the manway of the storage tank.

15. A method as in claim 14, wherein:

a) the blind flange manhole is unbolted from the manway.

16. A method as in claim 15, wherein:

a) the outwardly opening hinged door manhole cover is bolted to the manway.

17. A method as in claim 14 wherein:

a) the outwardly opening hinged door manhole cover is welded to the manway.

* * * * *